US005228165A

United States Patent [19]

Westberry et al.

[11] Patent Number: 5,228,165

[45] Date of Patent: Jul. 20, 1993

[54] WALL MOUNT BATH BRUSH AND METHOD

[76] Inventors: Sharon D. Westberry; Robert L. Westberry, both of 4261 SW. 53rd Ave., Davie, Fla. 33314

[21] Appl. No.: 807,176

[22] Filed: Dec. 16, 1991

[51] Int. Cl.[5] ..... A47K 7/02

[52] U.S. Cl. ..... 15/160; 4/559; 4/606; 15/210.1

[58] Field of Search ..... 15/227, 110, 114, 210 R, 15/160; 4/606, 559

[56] References Cited

U.S. PATENT DOCUMENTS

| | | | |
|---|---|---|---|
| 1,954,940 | 4/1934 | Mikel | 15/110 X |
| 3,631,560 | 1/1972 | Atkins | 4/606 X |
| 3,750,226 | 8/1973 | Morgan | 4/606 X |
| 4,759,091 | 7/1988 | Kiss | 15/105 |
| 5,072,480 | 12/1991 | Peters et al. | 15/114 |

*Primary Examiner*—Chris K. Moore
*Attorney, Agent, or Firm*—Oltman and Flynn

[57] ABSTRACT

A brush for scrubbing and scratching the human body includes a plate portion having a front face and a rear face, a plurality of bristles extending from the front face and an attachment mechanism for attaching the brush to a wall with the front face being directed away from the wall. The attachment mechanism preferably provides removable attachment to a wall, and may be a plurality of suction cups. The front face of the plate portion preferably has essentially the same surface area as an average person's back. The outer edges of the front face optionally have the essential outline of the upper human torso. The bristles optionally have a stiffness and an end roundness suitable for comfortably scratching a person's back when dry. The bristles are preferably provided in clusters, and each cluster of bristles may converge into a first end of a stem member extending through the plate portion, and a suction cup may be attached to a second end of the stem member. A method of scrubbing one's back with a bath brush attached to a wall, the bath brush having outward extending bristles, includes the steps of leaning one's back against the bristles of the brush and moving one's body relative to the wall.

8 Claims, 3 Drawing Sheets

WALL MOUNT BATH BRUSH AND METHOD

BACKGROUND OF THE INVENTION

1. Field of the Invention

The present invention relates generally to the field of brushes for bathing, and more specifically to a brush which is removably attached with suction cups to a shower room wall against which a bather leans and rubs his back, which does not require the awkward contortioning associated with use of a conventional long handled bath brush.

2. Description of the Prior Art

There have long been brushes for scrubbing the human body, and particularly the back, during bathing. The vast majority of these brushes are small bristled plates at one end of a handle. The other end of the handle is often shaped as a hook for hanging the brush on the shower curtain rod or towel rack between uses. An example is the BODY BRUSH TM by EMPIRE TM.

A problem with scrubbing the back with such a brush is that the bather must twist in awkward positions to reach around the chest and over the shoulders. This procedure can be difficult for the elderly and impossible for those having disabilities, who are recovering from surgery, or who have other ailments. Because it is awkward and time consuming, children or persons simply in a hurry may not take the time necessary for this important part of personal hygiene.

Another problem is that, to keep the brush from becoming cumbersome, its bristled portion is invariably small relative to the size of the human back, making numerous sweeps necessary for total coverage. Another problem is that, since the handle portions are usually long, narrow plastic members, they can break off and render the brush useless.

Still another problem is that, where very young children are bathing together, one of them might find the brush and strike the other with it, in well-meaning fun with unfortunate consequences. Still another problem is that the bather may discover that the brush is missing while he is already bathing, it having been lost or simply left elsewhere in the house as a result of its ready mobility. Still another problem is that the brush can be dropped or otherwise find its way to the floor of the bath tub, where the bather can step on it and suffer a slip and fall injury.

It is thus an object of the present invention to provide a bath brush which does not require the bather to twist and contort to scrub his back.

It is another object of the present invention to provide such a brush which can remain fixed to a wall, both during and between uses, so that it is never misplaced or mishandled by children.

It is still another object of the present invention to provide such a brush which has a large enough bristled surface to cover most of the average person's back in a single sweep, and yet not be cumbersome to use.

It is still another object of the present invention to provide such a brush which is unique in design and manner of use, and thus can be enjoyed as a novelty item.

It is finally an object of the present invention to provide such a brush which is simple, durable and inexpensive to produce.

SUMMARY OF THE INVENTION

The present invention accomplishes the above-stated objectives, as well as others, as may be determined by a fair reading and interpretation of the entire specification.

A brush is provided for scrubbing and scratching the human body, which includes a plate portion having a front face and a rear face, a plurality of bristles extending from the front face and an attachment mechanism for attaching the brush to a wall with the front face being directed away from the wall. The attachment mechanism preferably provides removable attachment to a wall, and may be a plurality of suction cups. The front face of the plate portion preferably has essentially the same surface area as an average person's back. The outer edges of the front face optionally have the essential outline of the upper human torso. The bristles optionally have a stiffness and an end roundness suitable for comfortably scratching a person's back when dry. The bristles are preferably provided in clusters, and each cluster of bristles may converge into a first end of a stem member extending through the plate portion, and a suction cup may be attached to a second end of the stem member.

A method is also provided of scrubbing one's back with a bath brush attached to a wall, the bath brush having outward extending bristles, including the steps of leaning one's back against the bristles of the brush and moving one's body relative to the wall.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
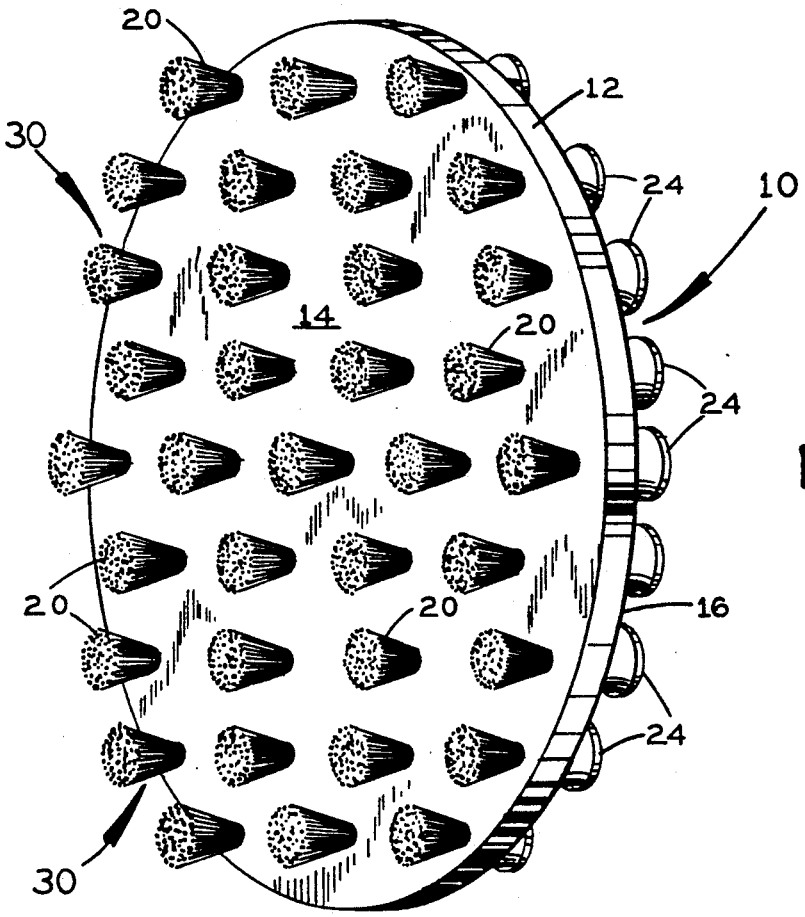
FIG. 1 is a perspective view of the inventive bath brush, having the optional disk shape, showing the suction cup attachment feature.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Referring to FIG. 1, a bath brush 10 is disclosed which includes a plate 12 having a front face 14 and a rear face 16. Bristles 20 extend from front face 14 for sliding against the body during bathing. A plurality of suction cups 24 extend from rear face 16 to hold brush 10 to a shower room wall. Brush 10 is attached at a convenient elevation for the bather to place his back against it. Then the bather simply moves his body from side to side and up and down, so that his back slides against bristles 20 in a cleaning and massaging action. Bath brush 10 can also be used as a back scratcher in a recreation room or bedroom, preferably with a stiffer grade of bristles 20.

The area of front face 14 is preferably close to the area of the average person's back, for rapid and easy cleaning. Since brush 10 remains affixed to a wall, it is not handled during use and therefore can have a large bristle 20 surface area. This large bristled area is not practical for prior art bath brushes with handles.

Figure 2:
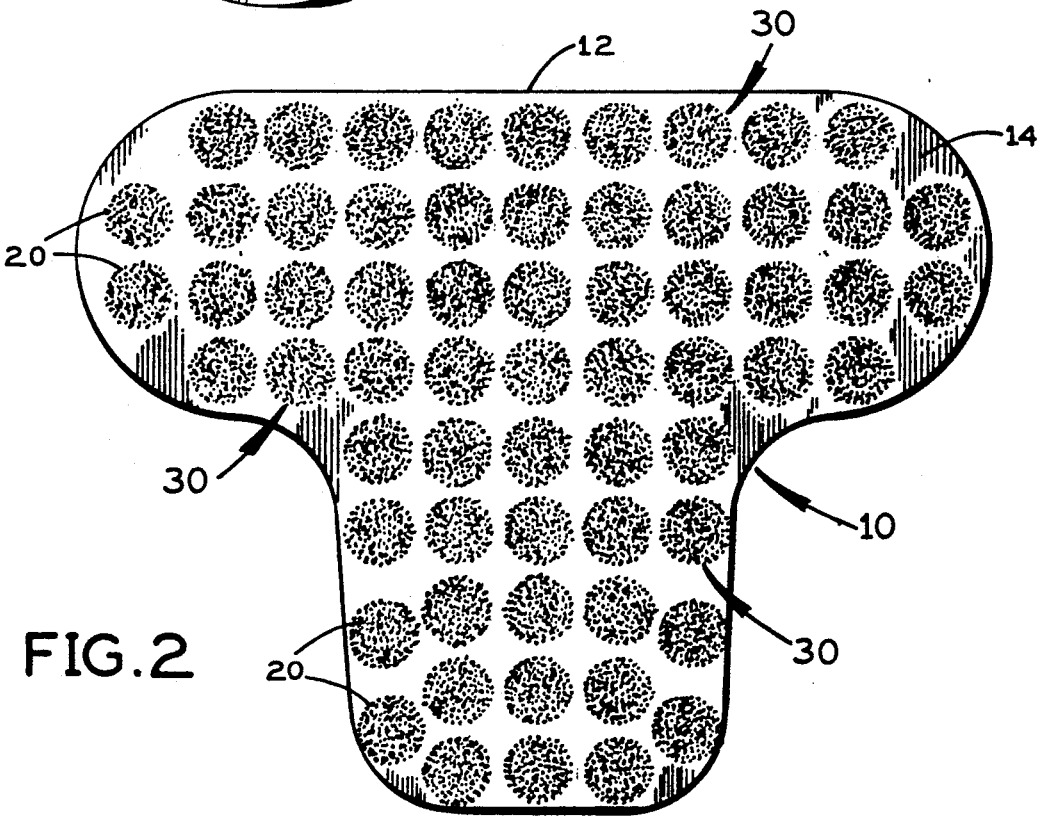
FIG. 2 is a front view of the inventive bath brush, having the optional upper torso shape.
Figure 3A:
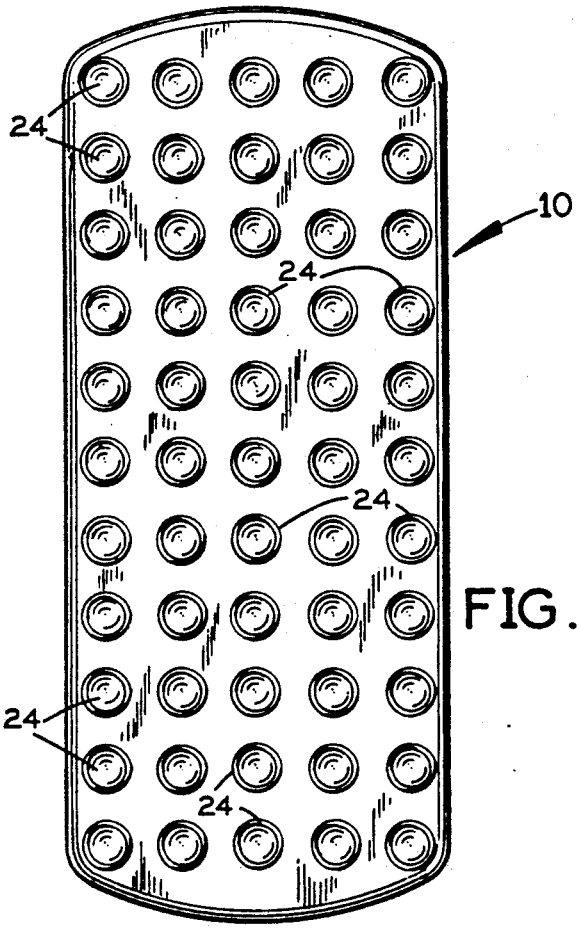
FIGS. 3*a*, 3*b* and 3*c* are rear view, side view, and front view, respectively of two alternative brush shapes.
Figure 3B:
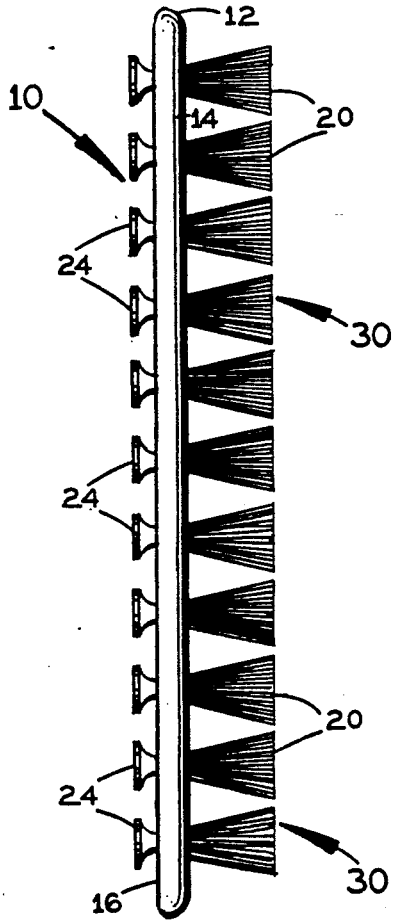
Figure 3C:
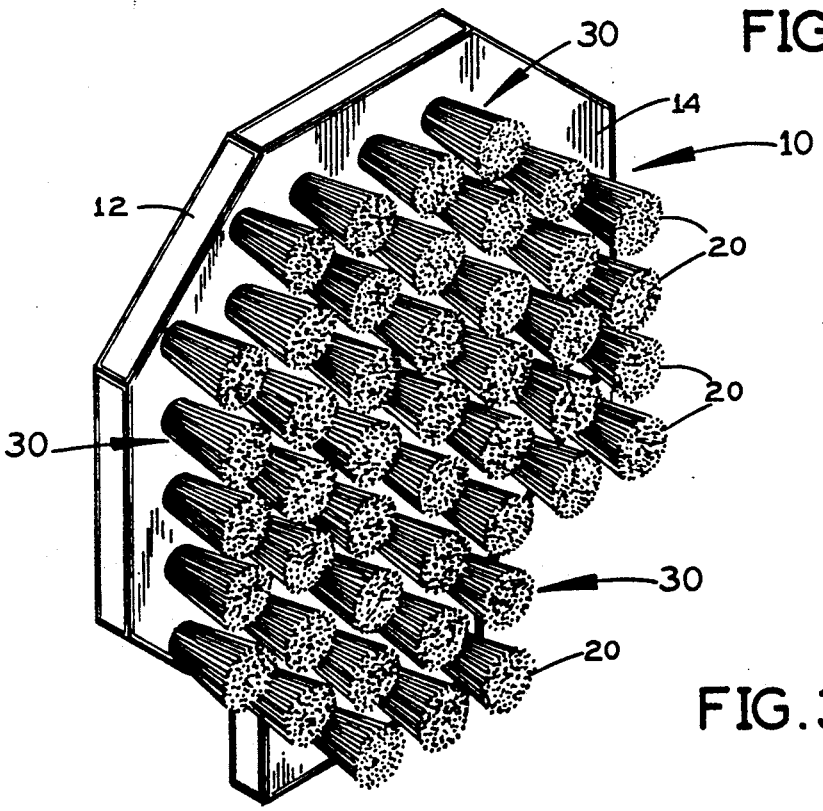

Plate 12 may take many shapes, such as the disk shape shown in FIG. 1 or the upper torso shape shown in FIG. 2. Other specifically contemplated shapes include rectangular, oval and octagonal, and those in shown FIG. 3. Plate 12 is preferably cut from a sheet of one quarter inch thick mildew-resistant rubber or vinyl material, or individually molded to this thickness. Plate 12 may be of many different colors or color patterns to match those of a variety of bathrooms. The large front face 14 area makes brush 10 ideally suited to incorporating a logo design or, if for a child, a picture of an agreeable cartoon character.

Figure 4:
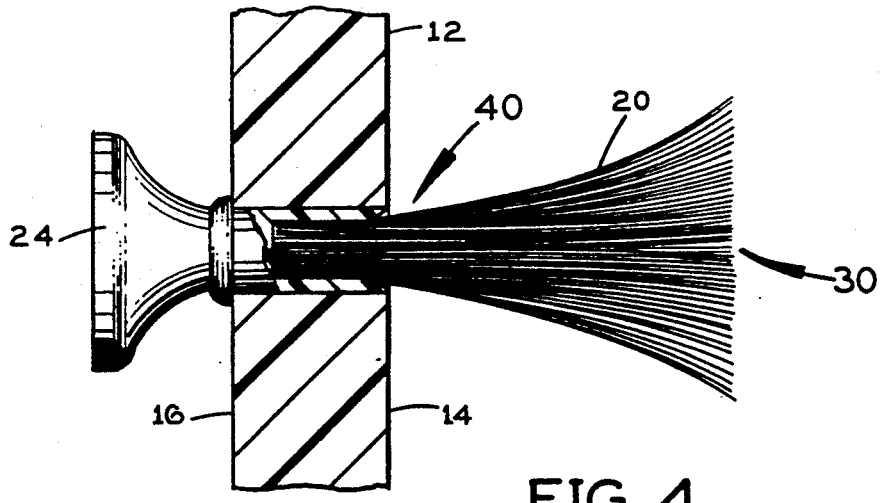
FIG. 4 is a cross-sectional side view of a segment of the brush, showing a bristle and suction cup mounting stem assembly.
Figure 5:
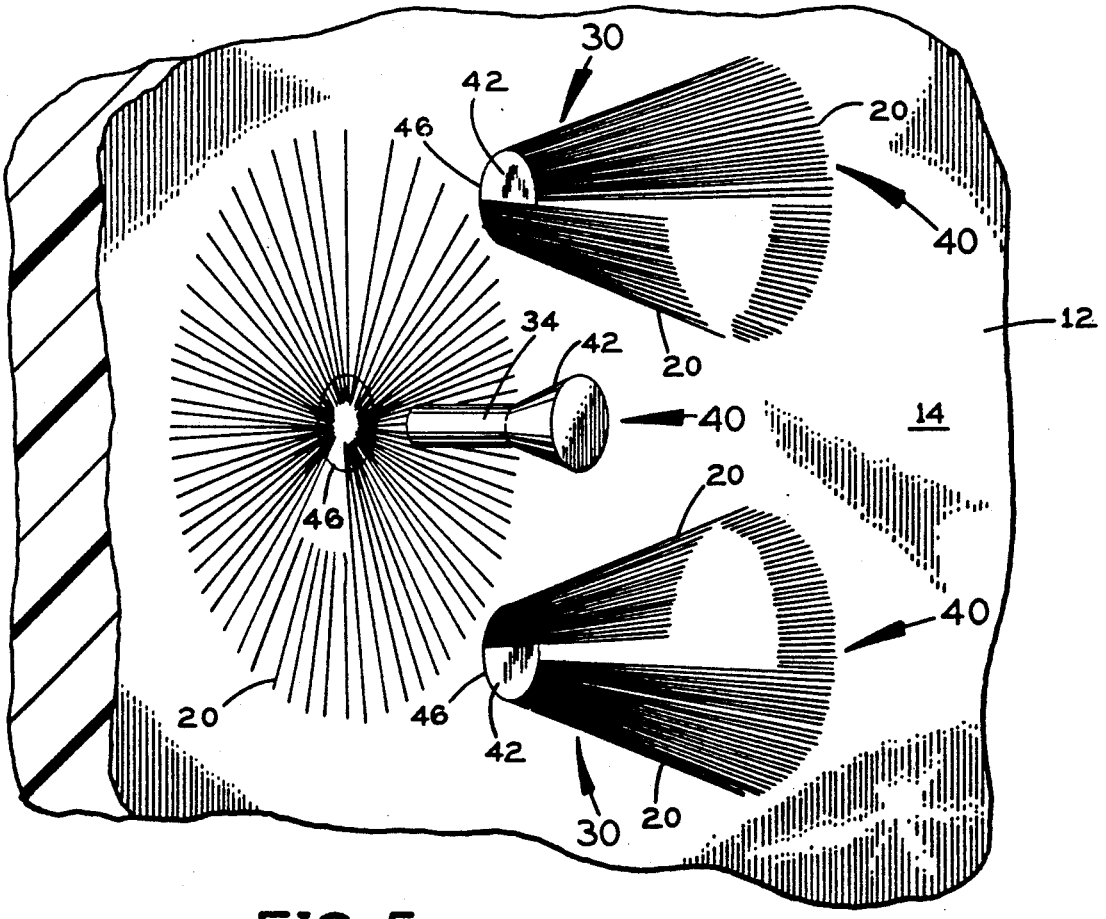
FIG. 5 is a perspective close-up view of the front of the brush illustrating the stopper and beveled mounting hole feature for mounting bristles in circular clusters.

Bristles 20 are preferably made of nylon and bunched together in clusters 30 which are uniformly distributed over front face 14. For ease of manufacture, each cluster 30 preferably fits into an end of a plastic stem member 34. Stem member 34 has a length essentially equal to the thickness of plate 12 and a single suction cup 24 extending from its other end. See FIG. 4. In molding plate 12, these cluster 30-stem member 34-suction cup 24 assemblies 40 can be positioned in the mold and the rubber or vinyl material poured around them. Alternatively, the bristle end of stem member 34 may be a beveled stopper 42 fitting into a correspondingly beveled hole 46 in an already formed plate 12. See FIG. 5. Bristles 20 can then be placed around the circumference of hole 46 and stem 34 fit through hole 46 so that stopper 42 wedges between and grips bristles 20 in a circular arrangement.

Method

A method of using the above-described invention includes the following steps: mounting the brush on a wall, leaning one's back against the bristles of the brush, and moving one's body relative to the wall.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim as our invention:

1. A brush for scrubbing and scratching the human body, comprising:

a plate portion having a front face and a rear face, a plurality of bristles extending from the front face, attachment means for attaching the brush to a wall with the front face being directed away from the wall, the bristles being provided in clusters, each cluster of bristles converging into a first end of a stem member extending through the plate portion and a suction cup attached to a second end of the stem member.

2. A brush as in claim 1, wherein the attachment means provide removable attachment to a wall.

3. A brush as in claim 2, wherein the attachment means is a plurality of suction cups.

4. A brush as in claim 1, wherein the front face of the plate portion has essentially the same surface area as a person's back.

5. A brush as in claim 1, wherein the bristles have a stiffness and end roundness suitable for comfortably scratching a person's back when dry.

6. A brush for scrubbing and scratching the human body, comprising:

a plate portion having a front face and a rear face, attachment means for attaching the brush to a wall with the front face being directed away from the wall, a plurality of bristles provided in clusters extending from the front face, wherein each said cluster of bristles converges against a first end of a stem member extending through the plate portion and a suction cup is attached to a second end of the stem member.

7. A brush as in claim 1, wherein a logo design is provided on said front face.

8. A brush as in claim 1, wherein a picture is provided on said front face.

* * * * *